US006772886B2

(12) United States Patent
Werner et al.

(10) Patent No.: US 6,772,886 B2
(45) Date of Patent: Aug. 10, 2004

(54) DEVICE FOR SORTING BILLS

(75) Inventors: Frank Werner, Munich (DE); Alois Wagner, Olching (DE); Markus Sperl, Munich (DE); Ralf Linck, Munich (DE); Hermann Weilacher, Ampermoching (DE); Stefan Thoma, Brannenburg (DE); Hermann Gessler, Munich (DE)

(73) Assignee: Giesecke & DeVrient GmbH, Munich (DE)

( * ) Notice: Subject to any disclaimer, the term of this patent is extended or adjusted under 35 U.S.C. 154(b) by 64 days.

(21) Appl. No.: 10/148,167

(22) PCT Filed: Nov. 30, 2000

(86) PCT No.: PCT/EP00/12056

§ 371 (c)(1),
(2), (4) Date: Aug. 16, 2002

(87) PCT Pub. No.: WO01/41078

PCT Pub. Date: Jun. 7, 2001

(65) Prior Publication Data

US 2003/0038062 A1 Feb. 27, 2003

(30) Foreign Application Priority Data

Dec. 2, 1999 (DE) ..... 199 58 017

(51) Int. Cl.[7] ..... G07D 7/02
(52) U.S. Cl. ..... 209/534; 271/264; 271/273
(58) Field of Search ..... 209/534; 271/264, 271/273

(56) References Cited

U.S. PATENT DOCUMENTS 4,402,410 A 9/1983 Ohba et al. ..... 209/534
4,694,963 A * 9/1987 Takesako ..... 209/534
4,784,274 A * 11/1988 Mori et al. ..... 209/534
5,657,846 A * 8/1997 Schwartz ..... 194/206
5,852,462 A * 12/1998 Lloyd et al. ..... 347/156
6,311,819 B1 * 11/2001 Stromme et al. ..... 194/207
6,321,894 B1 * 11/2001 Johnsson ..... 194/208

FOREIGN PATENT DOCUMENTS

| | | |
|---|---|---|
| DE | 32 47 267 C2 | 12/1982 |
| DE | 40 13 585 A1 | 4/1990 |
| DE | 198 10 928 A1 | 3/1998 |
| WO | EP 0 334 309 A | 9/1989 |
| WO | EP 0 952 556 A | 10/1999 |

* cited by examiner

*Primary Examiner*—Donald P. Walsh
*Assistant Examiner*—Kaitlin Joerger
(74) *Attorney, Agent, or Firm*—Bacon & Thomas, PLLC

(57) ABSTRACT

The present invention relates to a bank note sorting apparatus.

Known such apparatuses have the disadvantage of not being user-friendly since the transport path of the bank notes is not readily accessible to a user due to the elaborate mechanical design of the transport system. Bank notes that block the transport system due to faulty transport can therefore not be readily removed.

In the present invention this disadvantage is avoided by the bank note sorting apparatus consisting of at least three parts, with one part disposed in the middle and at least two parts removable therefrom, thereby obtaining easy access to the transport system.

18 Claims, 3 Drawing Sheets

DEVICE FOR SORTING BILLS

BACKGROUND OF THE INVENTION

The present invention relates to an apparatus for sorting bank notes.

DE 33 33 365 A1 discloses an apparatus for sorting bank notes according to the preamble of claim 1 having an input pocket for receiving bank notes, a singling device, a transport system, a checking device disposed along the transport system and at least one deposit device. Compact apparatuses for sorting bank notes, for example table apparatuses as known from EP 0 952 556 A2, usually have the problem of providing a sufficiently long transport path for the transport system to have sufficient room above all for the checking device and deposit devices. The prior art indicates that this problem can be solved by having the transport system extend in a loop shape, resulting in an altogether longer transport path at the same time as a compact construction.

However, the known device has the problem that the transport system and thus the transport path of the bank notes is not readily accessible to a user. Bank notes that block the transport system due to faulty transport can therefore not be readily removed.

SUMMARY OF THE INVENTION

It is the problem of the present invention to state an apparatus for sorting bank notes that has a compact construction and provides good access to the transport system.

The initial consideration here is to design the structure of the bank note sorting apparatus so as to provide good access to the transport system. This is obtained by dividing the bank note sorting apparatus substantially over three parts, a stationary middle part being surrounded by two removable outer parts. Removing the outer parts provides good access to the transport system disposed substantially along the separating line between the three parts.

In a development it is provided that the transport system extends substantially parallel to the outer contours of the bank note sorting apparatus. This permits the apparatus to be opened especially well along the transport system since in this case no areas covered by the parts of the apparatus can arise in the transport system.

In another development it is provided that the transport system itself can be divided up. This is obtained by distributing the elements of the transport system over the three parts of the bank note sorting apparatus such that the transport system is opened upon removal of the two outer parts along the transport path of the bank notes.

DESCRIPTION OF THE DRAWINGS

The invention will be explained in more detail in the following with reference to figures, in which.

DETAILED DESCRIPTION OF VARIOUS EMBODIMENTS OF THE INVENTION

Like elements shown in the figures are marked by the same reference signs.

Figure 1:
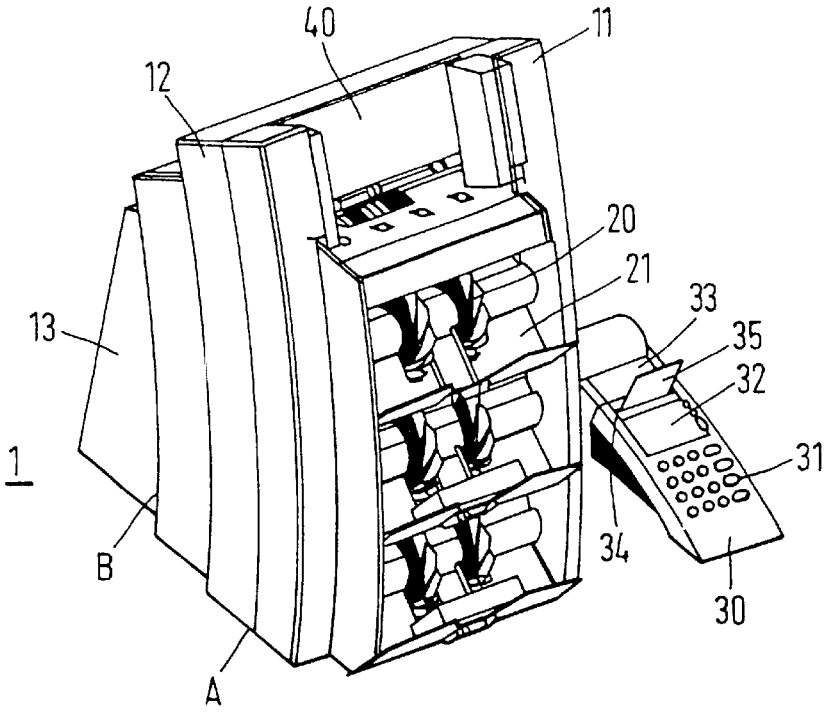
FIG. 1 shows a schematic representation of an embodiment of an inventive bank note sorting apparatus in the closed state.

FIG. 1 shows a schematic representation of an embodiment of inventive bank note sorting apparatus 1 in the closed state. Bank note sorting apparatus 1 has three parts 11, 12, 13. The three parts consist of middle, stationary part 12 surrounded by removable, outer parts 11 and 13. In the area of one of outer parts 11 there is input pocket 40 in which the bank notes to be sorted are placed. Furthermore, three like deposit devices 20, 21 for bank notes are located in said outer part 11. The elements of the uppermost of the three deposit devices 20, 21 are designated more closely. Said device has spiral stacker 20 and output pocket 21. In order to obtain a compact structure of bank note sorting apparatus 1, the bank notes are processed in the cross direction, i.e. the bank notes are transported along their cross format and all processing steps are effected along the cross format of the bank notes.

The compact design yields advantages with respect to ergonomic requirements since apparatus 1 is therefore suitable for being operated by either a seated or a standing user because input pocket 40 and deposit devices 20, 21 are within arm's reach.

Bank note sorting apparatus 1 has operating device 30 having input unit 31, display unit 32 and printer 33 as well as an interface or reading device 34 for storage medium 35. Input unit 31 and display unit 32 are used for controlling the bank note processing apparatus during operation and for example selecting desired sorting possibilities. Storage medium 35 makes it possible for a user to identify himself as an authorized user vis-à-vis apparatus 1. It is likewise possible for user-specific operating modes, settings or accounting data to be stored on storage medium 35, thereby permitting user-specific operation, or the use of the stored data on other apparatuses. Storage medium 35 can be for example a smart card or flash memory card with corresponding interface 34. Operating device 30 can be connected with bank note sorting apparatus 1 by wire or wirelessly, e.g. by means of infrared or radio waves. The use of external operating device 30 results in an improvement particularly with respect to ergonomic requirements because operating device 30 is not firmly connected with apparatus 1 so that it is possible for a user to dispose operating device 30 in accordance with his physical requirements.

The three parts 11, 12, 13 of bank note sorting apparatus 1 form two outer parts 11 and 13 and inner part 12, whereby outer parts 11 and 13 can be opened and in the closed state lie against inner part 12 along the contours designated A and B.

Figure 2:
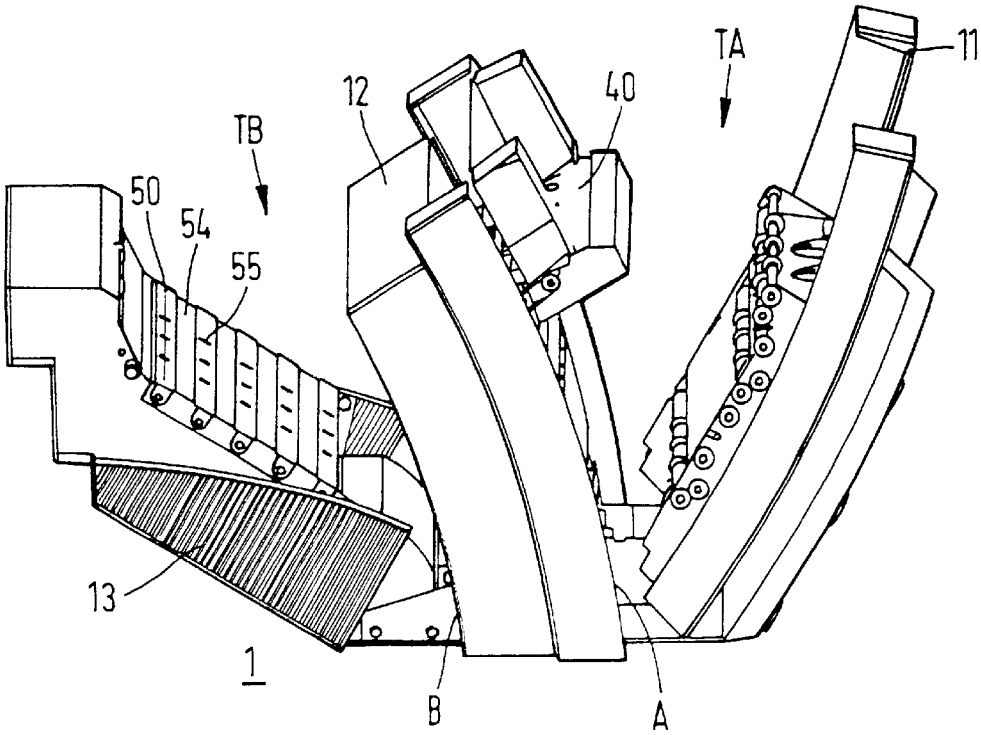
FIG. 2 shows a schematic representation of the apparatus according to FIG. 1 in the open state.

FIG. 2 shows a schematic representation of bank note sorting apparatus 1 according to FIG. 1 in the open state. Outer parts 11 and 13 are swiveled away from inner part 12 and parts of the transport system transporting the bank notes are visible. The transport system consists substantially of two portions TA and TB which are again predetermined substantially by the contours designated A and B.

Figure 3:
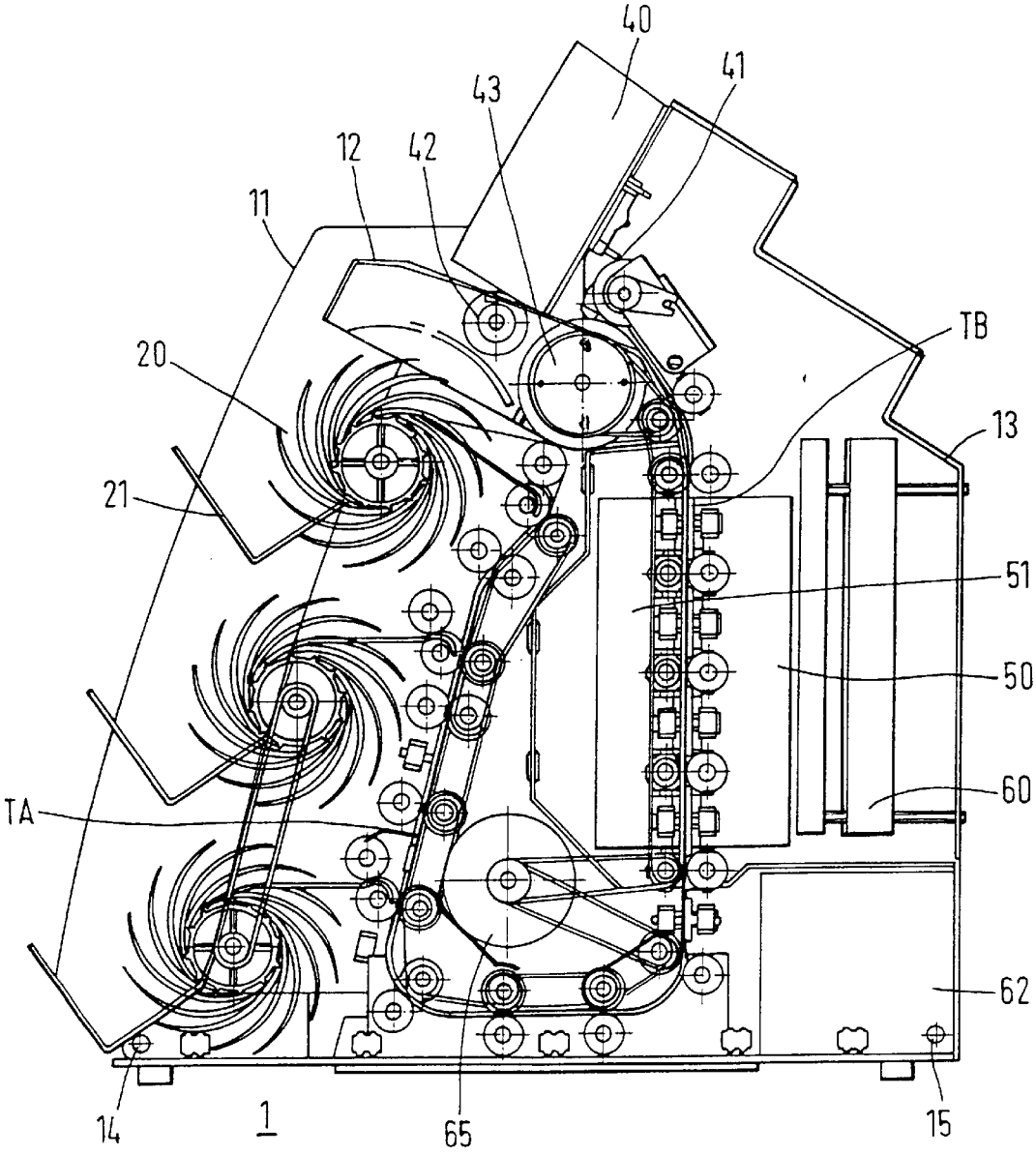
FIG. 3 shows a section at right angles to the transport path of the bank notes through the apparatus according to FIG. 1.

FIG. 3 shows a section at right angles to the transport path of the bank notes through bank note sorting apparatus 1 according to FIG. 1 in the closed state, with the three parts 11, 12, 13 and further elements.

It can be seen that singling device 41, 42, 43 with singling wheel 43, retaining wheel 41 and feed 42 is disposed under input pocket 40. Feed 42 has the function of transporting the individual bank notes of an applied bank note stack to be singled to singling wheel 43 and retaining wheel 41. Singling wheel 43 and retaining wheel 41 can be designed for example as a friction wheel singler, it being ensured by defined ratios of friction of singling wheel 43 and retaining wheel 41 that only one bank note at a time is grasped and passed on to first portion TB of the transport system.

Portion TB of the transport system leads substantially through checking device 50, 51 for bank notes. Checking device 50, 51 is disposed on both sides of the transport system such that the bank notes transported along the transport path can be checked from both the front and back. Checking device 50, 51 is formed by two separate containers in which different sensors are disposed.

FIG. 2 shows the basic structure of one of containers 50 of checking device 50, 51. On the surface oriented toward the transport path, openings or windows 54 for the sensors alternate with elements of the transport system. The elements of transport system 55 are formed for example by rubber rolls. This avoids the use of transport belts within checking device 50 so that the sensors can evaluate the total area of the transported bank notes. The elements of transport system 55 are connected with checking device 50, 51 or the containers, resulting in easy replaceability of total checking device 50, 51.

FIG. 3 furthermore shows controller 60, for example a microprocessor with an associated memory, that controls the sorting and deposit process in bank note sorting apparatus 1, in particular evaluating the signals from the sensors of checking device 50, 51. Further, power unit 62 for supply power to bank note sorting apparatus 1 and driving unit 65, e.g. an electric motor, for the transport system are shown.

After checking device 50, 51 the bank notes are transported further from first portion TB to second portion TA of the transport system. The checked bank notes are deposited, under the control of controller 60, in the deposit devices disposed along second portion TA, the last of which in the direction of the transport path being marked by reference signs 20, 21. For this purpose, diverters present in the transport system are driven to guide bank notes to the particular deposit device in accordance with the result of the check and the sorting possibility selected by operating device 30. Deflection of the transported bank notes after checking device 50, 51 from portion B to portion A of the transport system gives rise to a trailing zone for the bank notes. This provides a greater time period for controller 60 to evaluate the signals delivered by checking device 50, 51, so that reduced efficiency (computer power or storage capacity) of controller 60 is acceptable for performing the check of the bank notes during the resulting longer transport time of the bank notes.

Figure 4:
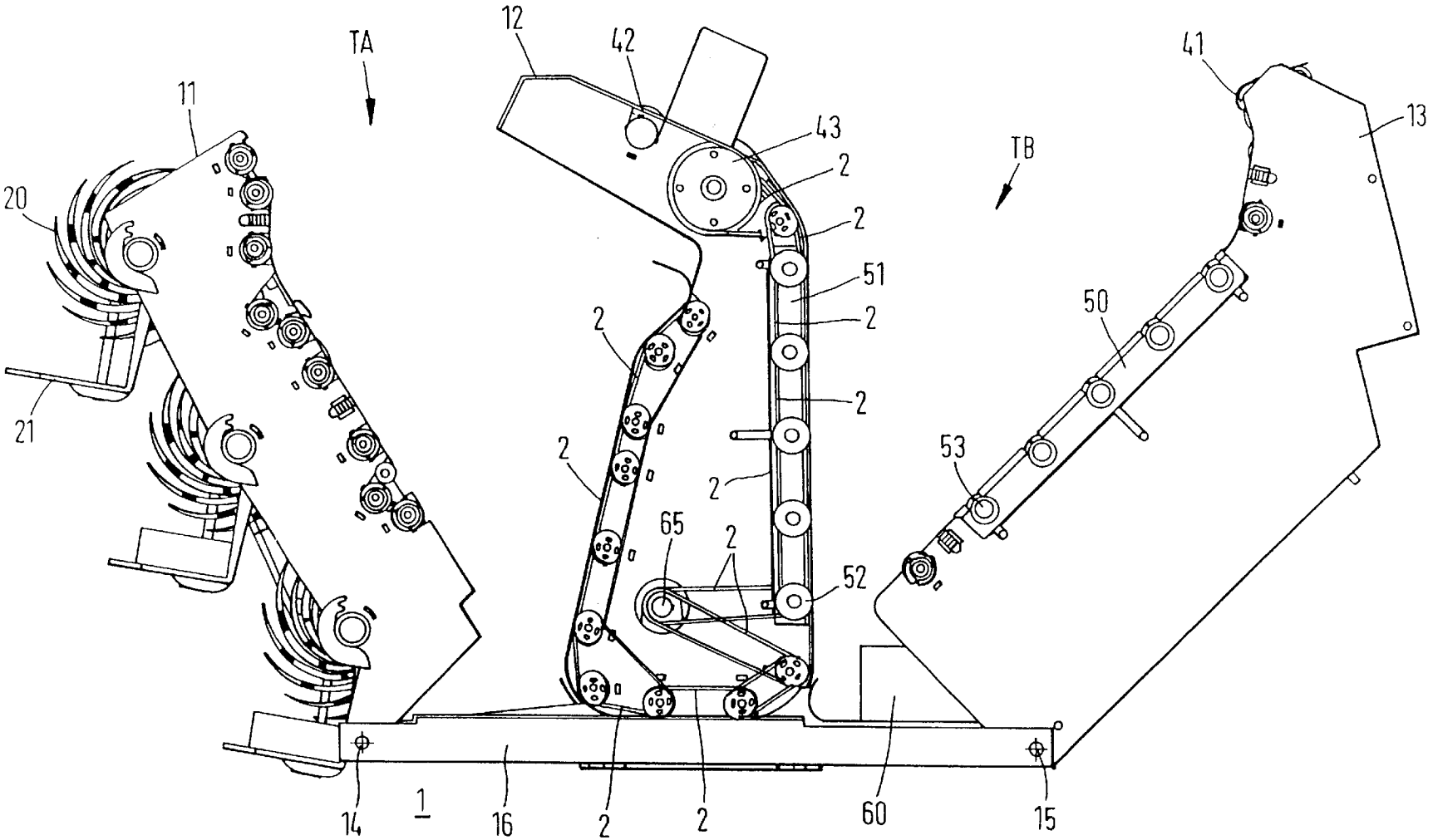
FIG. 4 shows a section at right angles to the transport path of the bank notes through the apparatus according to FIG. 2.

FIG. 4 shows a section at right angles to the transport path of the bank notes through bank note sorting apparatus 1 according to FIG. 2 or FIG. 3 in the open state.

In the representation, the two outer parts 11 and 13 of apparatus 1 are swiveled about axles 14 and 15. Axles 14 and 15 are fastened to baseplate 16 on which middle; stationary part 12 is also mounted. Middle, stationary part 12 retains its position in the open state. In middle, stationary part 12 motor 65 is disposed for driving the transport system by means of belts or toothed belts 2. It is likewise possible to use toothed wheels instead of the belts shown. FIG. 4 indicates that only the element of the transport system disposed in middle, stationary part 12 is driven by means of belts 2 directly by the motor. The elements of the transport system in outer, removable main parts 11 and 13 are driven by corresponding elements of the transport system in middle, stationary main part 12 when apparatus 1 is closed. Driving energy can be transferred by means of friction, e.g. by means of rubber rolls; or by means of toothed wheels.

FIG. 4 also indicates that the elements of transport system 55 within checking device 50, 51 are connected firmly therewith. Replacement is thus readily possible, as described above. This also holds for container 51 of checking device 50, 51, said container being located in middle, stationary part 12 of apparatus 1, since the elements of the transport system of container 51 are only tied into the drive of the transport system by means of two belts 2.

Further, FIGS. 3 and 4 indicate that the transition along the transport path of the transport system from portion TB to portion TA is designed so as to form only a short, readily accessible transition area from which any faultily transported bank notes can be removed without problems. In order to improve accessibility further, an axle can also be provided in the area of baseplate 16 for inner part 12, about which the middle part can be swiveled. This permits the portion of the transport system between baseplate 16 and inner part 12 to be readily accessible as well.

Described bank note sorting apparatus 1 has the advantage that in particular the transport path of the bank notes along critical devices, such as singler 41, 42, 43, checking device 50, 51 and deposit device 20, can be opened, so that any bank note jams that occur can be removed without problem. The use of only one swivel axle 14, 15 for each of portions TA, TB of the transport system results in a mechanical structure that has the advantage of making areas accessible along the transport system that are very easily surveyed and can be opened wide for troubleshooting or maintenance. Instead of swivel axles, 14, 15 one can use rails or the like on which outer parts 11, 13 can be removed by shifting middle part 12.

In order to recognize faultily transported bank notes one can use sensors, for example light barriers, that are disposed along the transport system. Suitable places for such sensors are before or after the individual devices of bank note processing apparatus 1, namely singling device 41, 42, 43, checking device 50, 51 and the deposit devices or the above-described diverters in the transport system. If faulty transport is recognized by the sensors, it can be indicated for example on display 32 of external operating device 30 which of removable, outer parts 11 and/or 13 should be opened for eliminating the error. This avoids unnecessary opening of one of parts 11 and 13. It is likewise possible to provide a display, e.g. a light-emitting diode, on outer parts 11 and 13 for indicating part 11 and/or 13 to be opened. The sensors for recognizing faulty transport are evaluated by controller 60 which drives the display accordingly.

Further displays can be provided for the three output pockets for indicating when a predetermined maximum number of bank notes has been deposited in the particular output pocket since said output pocket is otherwise no longer available for further processing. The displays can be located directly on the output pockets or the display can be effected on display 32 of external operating device 30. The full display is driven by controller 60 when a sensor in the particular output pocket signals that the maximum number of bank notes has been deposited. The maximum number of bank notes to be deposited can also be determined by controller 60 by the latter counting the bank notes deposited in an output pocket during processing until a presettable variable, e.g. 100 bank notes, is reached. After removal of the bank notes by a user, which can be determined e.g. by evaluation of the particular sensor in the particular output pocket by controller 60, the particular output pocket is available again for receiving further bank notes, thereby permitting altogether faster processing of the bank notes to be processed.

What is claimed is:

1. An apparatus for sorting bank notes comprising an input pocket for receiving the bank notes, a singling device associated with the input pocket, a transport system, a checking device disposed along the transport system, and at least one deposit device with an output pocket for depositing bank notes in dependence on the result of the checking device, wherein the apparatus further comprises at least three parts including a middle part and at least two outer parts removable therefrom, at least the transport system in the area of the checking device and in the area of the deposit device being freely accessible after removal of the outer parts.

2. An apparatus according to claim 1, wherein the transport system is distributed over the three parts of the apparatus, and upon removal of the outer parts from the inner part the transport system itself is separated along a line corresponding to the transport path of the bank notes.

3. An apparatus according to claim 1 wherein the transport system has a driving unit, in particular a motor, disposed in the inner part and driving solely elements of the transport system housed in the inner part by means of driving elements, such as toothed wheels or belts, the elements of the transport system in the two outer parts being driven in the closed state of the apparatus by corresponding elements of the transport system of the inner part.

4. An apparatus according to claim 1, wherein the outer parts of the apparatus are mounted in openable fashion along two swivel axles, and the inner part is stationary.

5. An apparatus according to claim 1, wherein the outer parts of the apparatus are mounted in openable fashion along rails, and the inner part is stationary.

6. An apparatus according to claim 1, wherein the transport system extends substantially parallel to the outer contours of the apparatus.

7. An apparatus according to claim 1, wherein the singling device is freely accessible after removal of at least one of the outer parts.

8. An apparatus according to claim 1, wherein the singling device is distributed over one of the outer parts and the inner part of the apparatus.

9. An apparatus according to claim 1, including a display device arranged to indicate, upon determination of improperly transported bank notes, in which area of the transport system the improperly transported bank notes are located.

10. An apparatus according to claim 1, wherein the checking device is distributed over one of the outer parts and the inner part of the apparatus, whereby elements of the transport system and openings or windows for sensors are provided in the checking device, of which only the elements of the transport system in the middle part of the apparatus are driven by the driving unit by means of driving elements, whereas the elements of the transport system in the outer part of the apparatus are driven in the closed state by corresponding elements of the transport system of the middle part of the apparatus.

11. An apparatus according to claim 1, wherein each of the deposit devices has associated therewith a display device arranged to indicate that a predetermined amount of bank notes has been deposited in the particular deposit device.

12. An apparatus according to claim 1, including an external operating device connected with the bank note processing apparatus by wire or wirelessly.

13. An apparatus according to claim 12, wherein the external operating device has a printer.

14. An apparatus according to claim 12 wherein the external operating device is connected with the bank note processing apparatus via an infrared interface.

15. An apparatus according to claim 1, wherein an interface is provided for a storage medium.

16. An apparatus according to claim 15, wherein the interface is disposed in the external operating unit.

17. An apparatus according to claim 15 wherein the storage medium is a smart card or flash memory card.

18. An apparatus according to claim 1 wherein the at least one deposit device is defined as a plurality of deposit devices.

* * * * *